United States Patent [19]

Yamamoto et al.

[11] Patent Number: 4,585,330

[45] Date of Patent: Apr. 29, 1986

[54] UNNECESSARY CHARGE REMOVING DEVICE FROM A LATENT IMAGE BEARING ELEMENT OF ELECTROPHOTOGRAPHIC COPYING MACHINE

[75] Inventors: Kazushi Yamamoto, Higashiosaka; Toyoki Tanaka, Yamatokoriyama, both of Japan

[73] Assignee: Sharp Kabushiki Kaisha, Osaka, Japan

[21] Appl. No.: 556,771

[22] Filed: Dec. 1, 1983

[30] Foreign Application Priority Data

Dec. 3, 1982 [JP] Japan ..... 57-183761[U]

[51] Int. Cl.[4] ..... G03G 15/04

[52] U.S. Cl. ..... 355/3 R; 355/71

[58] Field of Search ..... 355/1, 3 R, 3 ER, 7, 355/71

[56] References Cited

U.S. PATENT DOCUMENTS

| | | | |
|---|---|---|---|
| 3,514,200 | 5/1970 | Bowker | 355/1 |
| 3,784,301 | 1/1974 | Sato | 355/3 R X |
| 3,792,913 | 2/1974 | Simmons | 355/7 |
| 3,799,666 | 3/1974 | Fukushima et al. | 355/3 R |
| 3,967,896 | 7/1976 | Looney et al. | 355/3 R X |
| 4,344,691 | 8/1982 | Grant et al. | 355/1 |
| 4,427,284 | 1/1984 | Dannatt | 355/1 |

*Primary Examiner*—Fred L. Braun

*Attorney, Agent, or Firm*—Birch, Stewart, Kolasch & Birch

[57] ABSTRACT

An electrophotographic copying machine includes a device for removing charges of portions of a latent image bearing element which are unnecessary for forming a latent image. The device includes a light source, the latent image bearing element, and a light shade plate which is positioned between the light source and the latent image bearing element. The light source is positioned at the focus point of a fresnel lens. The device can be applied to a type of electrophotographic copying machine having a three-layered latent image bearing element.

6 Claims, 5 Drawing Figures

UNNECESSARY CHARGE REMOVING DEVICE FROM A LATENT IMAGE BEARING ELEMENT OF ELECTROPHOTOGRAPHIC COPYING MACHINE

BACKGROUND OF THE INVENTION

The present invention relates to an electrophotographic copying machine and, more particularly, to a device for removing charges unnecessary for forming a toner image on a latent image bearing element in an electrophotographic copying machine.

An electrophotographic copying machine produces an electrostatic latent image on a latent image bearing element such as a light sensitive photoconductive element with an optical system based on a reflected light image. The light sensitive photoconductive element is uniformly charged. The latent image corresponds to an image on a copy document such as a manuscript or book to be copied. Toner particles are electrically adhered to the latent image, so that the latent image becomes visible to form a toner image. The toner image is transferred onto a copy paper via a transference charger and fixed thereon.

Conventionally, the light sensitive photoconductive element is uniformly charged with a corona charger over its width. Therefore, when, for example, a reduced copy from the document is projected onto the light sensitive element, some nonused charges will remain at the portions of the light sensitive element except the projected portions. The development of this charge image at the developing section results in the fact that the toner particles are adhered on these portions as well as at the latent image portions. By the transference charger, an unnecessary toner fixed image may be produced around the periphery of the copied paper. Since the toner particles are adhered to the portions unnecessary for forming the toner image, the amount of toner particles is quickly reduced.

To prevent the above disadvantage, a device is presented for removing the charges on the portions unnecessary for the toner image. Conventionally, such a charge removing device acts to emit light on the portions unnecessary for the image, so that the charges are discharged. This device is positioned between the charger unit and the developing unit.

FIG. 1 shows a plan view of a conventional charge removing device. In FIG. 1, a light shade plate 3 is positioned between a light sensitive element 1 and a light source 2. To remove the charges unnecessary for the toner image on the light sensitive element 1, in accordance with the positions of the unnecessary portions of the light sensitive element 1, some light sources 2 are illuminated or, otherwise, the light shade plate 3 is moved at the desired image portions a to shade these portions.

However, it may be difficult to position this device adjacent the light sensitive element because of the need of a large area of space for this device. In case this device is positioned far from the light sensitive element, as FIG. 1 shows, the light from the light source 2 radiates. The light from the light source 2-1 is shut out by the light shade plate 3, so that the unnecessary charges at c position in unnecessary b portions cannot be removed. The light from the light source 2—2 removes the charges at the d portions in the desired a portions for the image. Here, the boundary between the a and the b portions is vague and the necessary charges may be removed. Of course, the light shade plate 3 may be positioned adjacent the light sensitive element so as to make the boundary between the a and the b portions clear. However, because of the space limitation, such a positioning may be difficult in many cases as stated above.

Further, even if a sufficient space for positioning the light exposuring device adjacent the light sensitive element is present, a specific material for the light sensitive element such as a three-layered material is usually used for improving charge bearing feature of the light sensitive element. In such a case, since a simultaneous charge and light exposure process should be applied, it is necessary to interpose a charger between the light sensitive element and the charge removing device, whereby the charge removing device must be positioned far from the light sensitive element owing to the presence of the charger. It is difficult to make the boundary between the a and the b portions clear, as such.

SUMMARY OF THE INVENTION

Accordingly, it is an object of the present invention to provide an improved device for removing charges unnecessary for forming a toner image on a latent image bearing element in a copying machine.

It is another object of the present invention to provide an improved device for removing charges unnecessary for forming a toner image on a latent image bearing element by emitting parallel rays toward the latent image bearing element in a copying machine.

It is a further object of the present invention to provide an improved electrophotographic copying machine comprising a device for removing charges unnecessary for forming a toner image on a latent image bearing element by exposing the latent image bearing element to parallel rays.

Briefly described, in accordance with the present invention, an electrophotographic copying machine includes a device for removing charges unnecessary for forming a toner image on a latent image bearing element such as a light sensitive element. The unnecessary charges do not provide any image from a copy document to be copied. The device includes a fresnel lens, a light source, and a light shade plate. The light shade plate can be reciprocated to provide a light path in the front of the latent image bearing element. The light shade plate is positioned between the latent image bearing element and the fresnel lens. The fresnel lens is provided for forming parallel rays of the light beams from the light source. The light source is positioned at the focus point of the fresnel lens. The light shade plate is provided in front of the fresnel lens for separating image portions and the remaining portions on the latent image bearing element unnecessary for forming the toner image.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
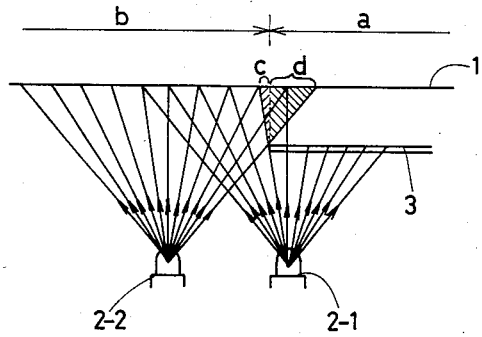
FIG. 1 shows a plan view of a conventional device for removing unnecessary charges from a latent image bearing element such as a light sensitive element.
Figure 2:
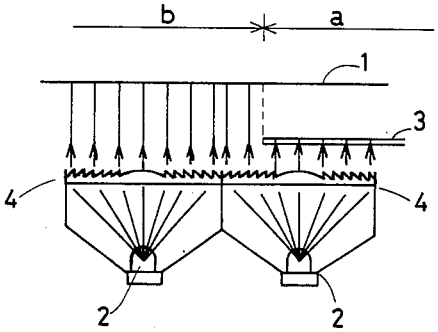
FIG. 2 shows a plan view of a device for removing unnecessary charges from the latent image bearing element according to the present invention.

FIG. 2 shows a plan view of a device for removing unnecessary charges from a latent image bearing element such as a light sensitive element according to the present invention.

The device of FIG. 2 includes a light sensitive photoconductive element 1, a plurality of light sources 2, a light shade plate 3, and a plurality of fresnel lenses 4. The shade plate 3 serves to shade the unnecessary portions of the light sensitive element 1 from the light of the plurality of light sources 2. The light shade plate 3 can be reciprocated linearly along the face of the element 1 according to the detection of a control circuit for detecting the size of a copy document. The light shade plate 3 is positioned between the light sensitive photoconductive element 1 and the plurality of fresnel lenses 4. The plurality of fresnel lenses 4 are provided for making the light beams radiated from the light sources 2 parallel with each other and normal to the surface of the element 1. For this purpose, each of the light sources 2 is positioned at the focus point of each of the fresnel lenses 4.

In favor of the application of the fresnel lens, the device can be made compact, light, and inexpensive. Such a fresnel lens can be easily made of a plastic plate as thin as about several mm.

In this arrangement, the light beams radiated from light sources 2 can be made parallel with each other by the fresnel lenses 4, so that they are incident upon the light sensitive photoconductive element 1. The paralleled beams are shaded by the light shade plate 3. The nonshaded light beams can be incident upon the light sensitive photoconductive element 1. The shade plate 3 is reciprocated and positioned so that the edge thereof meets with the edge between the image bearing portions and the non-image bearing portions of the element 1. The shade plate 3 shades the image bearing portions of the element 1 while it does not shade the non-image bearing portions thereof. The light beams cannot be incident upon a portions of the element 1 while they can be indicent upon b portions thereof. The charges on the b portions of the element 1 can be removed. The boundary between the a portions and the b portions of the element 1 is made clear.

The device of FIG. 2 can be positioned somewhat far from or, otherwise, adjacent the element 1. Since the reciprocation amount of the plate 3 can be selected in a linear scale, the size of the zone to be shaded can also be selected linearly.

Figure 3:
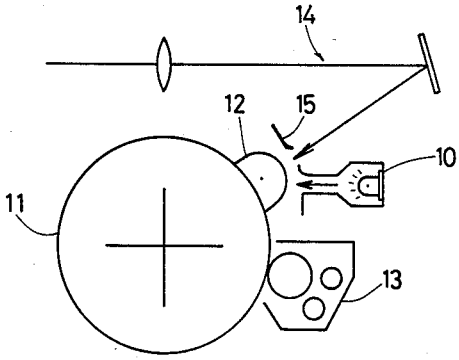
FIG. 3 shows a side view of an electrophotographic copying machine including the device of FIG. 2.

FIG. 3 shows a side view of an electrophotographic copying machine to which the device of FIG. 2 may be applied although not limited to this type of electrophotographic copying machine.

The electrophotographic copying machine of FIG. 3 includes a charge removing device 10, a three-layered light sensitive element 11, a charger 12, a developer 13, and an optical system 14 having a slit 15.

The three-layered light sensitive element 11 is formed around a drum. The three-layered light sensitive element 11 includes an electrically conductive base made of Al, a photoconductive layer made of CdS thereon, and an insulative layer made of MYLAR thereon. An example of such a three-layered element and an electrophotographic process associated therewith is disclosed in H. TANAKA et al, U.S. Pat. No. 3,666,363 issued on May 30, 1972, entitled "ELECTROPHOTOGRAPHIC PROCESS AND APPARATUS".

The charger 12 is provided for removing unnecessary charges which may have been previously charged. The developer 13 is provided for forming a toner image based on a latent image formed on the light sensitive element 11. The optical system 14 is provided for exposing a light reflected image from the copy document to the light sensitive element 11 with the help of the slit 15. The reflected image exposure on the light sensitive element 11 by the optical system 15 is performed simultaneously with the charging of the element 11 by the charger 12. Before the light sensitive element 11 faces the charger 12, the element 11 is pre-charged in a specific polarization. When the element 11 faces the charger 12, the charger 12 acts to provide corona charge and, simultaneously, through the charger 12, the reflected image exposure is perfomed on the element 11 by the optical system 14. Here, on the surface of the element 11, the latent image corresponding to the light image exposure is produced. Further, although not shown in the drawings, the element 11 is subjected to whole surface light exposure to improve the contrast of the latent image. Next, the developer 13 is activated to develop the latent image.

Figure 4:
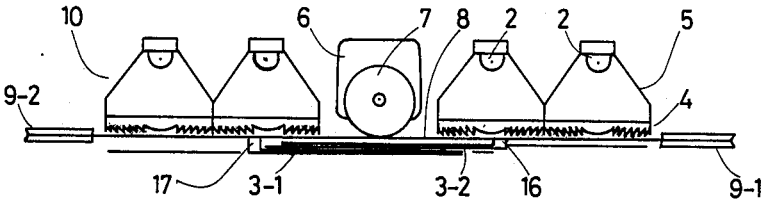
FIG. 4 shows a plan view of the device of FIG. 3.
Figure 5:
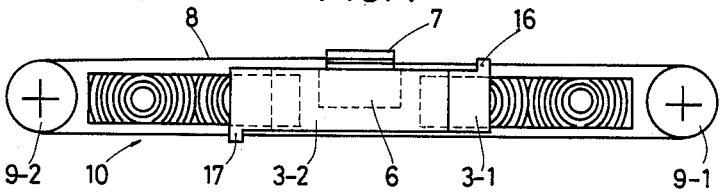
FIG. 5 shows a front view of the device of FIG. 3.

According to the present invention, during the process of the simultaneous charging and image exposure, the device 10 is provided to remove the unnecessary charges on the b portions of the element 11. FIGS. 4 and 5 show a plan view and a front view of the device 10, respectively.

Referring now to FIGS. 4 and 5, the light source 2 is positioned inside a light shield box 5, in which the fresnel lens 4 is disposed at the opening of the shield box 5 to form a single light unit. A plurality of light units are aligned along the longitudinal side of the light sensitive element 11. In front of the fresnel lens 4, two light shield plates 3-1 and 3-2 are supported and capable of being reciprocated. The two shield plates 3-1 and 3-2 are moved to the right and the left according to the rotation of a driving motor 6. A wire 8 is wound several turns around a driving pulley 7 of the driving motor 6. The wire 8 is extended between two pulleys 9-1 and 9-2 which are positioned far from the light units. The wire 8 is combined with each of two fixed points 16 and 17 of the two light shield plates 3-1 and 3-2.

Accordingly, the rotation of the driving motor 6 causes the two light shield plates 3-1 and 3-2 to be moved in the direction in which they are separated from each other since they are driven by the wire 8. When the motor 6 is rotated clockwise, the plate 3-1 is moved in the left direction and the plate 3-2 is moved in the right direction, to thereby narrow the zone of the a portions carrying the latent image, whereby the light beams are incident upon the b portions of the element 11 to remove the unnecessary charges from it.

On the contrary, when the motor 6 is rotated counterclockwise, they are moved so as to be super-imposed upon each other, to thereby widen the zone of the a portions on the light sensitive element 11.

The example as shown in FIGS. 4 and 5 is to restrict the zone on the light sensitive element at the center thereof since the center bears the latent image. It may be possible that a different portion on the element for bearing the latent image may be selected. For example, when the image zone is localized at one side of the element, a first light shade plate is localized and fixed near the one side while the other light shade plate is supported as being capable of being reciprocated. In such a case, the unit for providing the charge removing light is disposed near the other light shade plate.

While only certain embodiments of the present invention have been described, it will be apparent to those skilled in the art that various changes and modifications may be made therein without departing from the spirit and scope of the present invention as claimed.

What is claimed is:

1. A device for removing charges on unnecessary portions of a latent image bearing element surrounding a latent image formed on said element in an electrophotographic copying machine, said device comprising:

light source means for emitting light beams toward said latent image bearing element;

fresnel lens means, responsive to said light beams radiated from said light source means, for changing the light beams emitted from said light source means into parallel light beams; and light shade means for covering a selected portion of said latent image bearing element bearing said latent image to prevent contact with said parallel light beams, said parallel light beams developed by said fresnel lens means removing charges from the unnecessary portion of said latent image bearing element surrounding said latent image.

2. The device according to claim 1, further comprising a shield box means for housing said light source means and directing said light beams to said fresnel lens means.

3. The device according to claim 1, wherein said light shade means is reciprocated across said latent image bearing element.

4. The device according to claim 1 wherein a plurality of said light shade means are provided between said light source means and said fresnel lens means.

5. The device according to claim 1, further comprising means for controlling the size of said light shade means, said means for controlling being operatively interconnected to said light shade means by a wire.

6. The device according to claim 1, wherein said latent image bearing element is a light sensitive element.

* * * * *